US012085302B2

(12) United States Patent
Boyajian et al.

(10) Patent No.: US 12,085,302 B2
(45) Date of Patent: Sep. 10, 2024

(54) HVAC RETURN UNIT WITH A DIRECT JUMPER ARRANGEMENT

(71) Applicant: Boyjin Development LLC, Glendale, AZ (US)

(72) Inventors: Lance Boyajian, Glendale, AZ (US); Frank Boyajian, Glendale, AZ (US)

(73) Assignee: Boyjin Deveopment LLC, Glendale, AZ (US)

( * ) Notice: Subject to any disclaimer, the term of this patent is extended or adjusted under 35 U.S.C. 154(b) by 66 days.

(21) Appl. No.: 17/219,303

(22) Filed: Mar. 31, 2021

(65) Prior Publication Data

US 2021/0310692 A1 Oct. 7, 2021

Related U.S. Application Data

(60) Provisional application No. 63/005,712, filed on Apr. 6, 2020.

(51) Int. Cl.

| | |
|---|---|
| ***F24F 13/08*** | (2006.01) |
| ***F24F 7/04*** | (2006.01) |
| ***F24F 13/10*** | (2006.01) |
| ***F24F 13/28*** | (2006.01) |

(52) U.S. Cl.

CPC ..... *F24F 13/082* (2013.01); *F24F 7/04* (2013.01); *F24F 13/10* (2013.01); *F24F 13/28* (2013.01)

(58) Field of Classification Search

CPC ..... F24F 13/082; F24F 13/10; F24F 13/28; F24F 7/04; F24F 2011/0005

USPC ..... 454/245

See application file for complete search history.

(56) References Cited

U.S. PATENT DOCUMENTS

| | | | | | |
|---|---|---|---|---|---|
| 3,464,487 | A * | 9/1969 | Gold | F24F 13/10 | 55/354 |
| 4,778,496 | A * | 10/1988 | Conrad | F24F 8/108 | 55/472 |
| 5,080,403 | A * | 1/1992 | Paoluccio | F24F 13/0218 | 285/229 |
| 5,545,086 | A * | 8/1996 | Sharp | F24F 11/0001 | 454/238 |
| 6,063,170 | A * | 5/2000 | Deibert | B01D 46/22 | 261/80 |
| 6,231,704 | B1 * | 5/2001 | Carpinetti | F24F 13/02 | 285/284.1 |
| 6,849,107 | B1 * | 2/2005 | Huffman | B01D 46/521 | 261/80 |
| 7,252,696 | B2 * | 8/2007 | Jenkins | B01D 46/0005 | 55/490.1 |
| 8,690,999 | B2 * | 4/2014 | Meirav | B01D 53/62 | 165/59 |
| 9,121,620 | B2 * | 9/2015 | Rohde | F24F 3/0527 | |
| 2008/0119127 | A1 * | 5/2008 | Stewart | F24F 13/12 | 454/256 |

(Continued)

*Primary Examiner* — Avinash A Savani
*Assistant Examiner* — Ryan L Faulkner
(74) *Attorney, Agent, or Firm* — Polsinelli PC

(57) ABSTRACT

Various embodiments of a system and associated methods for an HVAC return unit with a direct jumper arrangement for improved control over volumetric flow rate and balance in an HVAC system are disclosed herein. The return unit allows for a single degree of separation between each room within a structure to better control airflow through a room regardless of its size or status as a peripheral room such as a bedroom or a communal room such as a hallway.

10 Claims, 11 Drawing Sheets

(56) References Cited

U.S. PATENT DOCUMENTS

| | | | | |
|---|---|---|---|---|
| 2012/0071082 | A1* | 3/2012 | Karamanos | F24F 5/0003 29/890.03 |
| 2012/0202415 | A1* | 8/2012 | Rudd | F24F 7/06 454/338 |
| 2013/0052936 | A1* | 2/2013 | Jordan | F24F 1/005 454/338 |
| 2013/0199142 | A1* | 8/2013 | Kerr, Jr. | F24F 13/085 29/402.08 |
| 2015/0298043 | A1* | 10/2015 | Meirav | B01D 53/04 96/111 |
| 2016/0281348 | A9* | 9/2016 | Karamanos | F24F 7/04 |
| 2017/0234575 | A1* | 8/2017 | Ihme | B01D 46/0005 55/495 |
| 2017/0356670 | A1* | 12/2017 | Zhang | F24F 11/77 |
| 2018/0216843 | A1* | 8/2018 | Zhou | F24F 11/54 |
| 2019/0145642 | A1* | 5/2019 | Heigl | F24F 11/0001 454/239 |
| 2019/0309985 | A1* | 10/2019 | Shepard | F24F 13/28 |

* cited by examiner

HVAC RETURN UNIT WITH A DIRECT JUMPER ARRANGEMENT

CROSS-REFERENCE TO RELATED APPLICATIONS

This is a non-provisional application that claims benefit to U.S. provisional patent application Ser. No. 63/005,712 filed on 6 Apr. 2020, which is herein incorporated by reference in its entirety.

FIELD

The present disclosure generally relates to HVAC systems, and in particular, to an HVAC return system including a return unit which uses a direct jumper arrangement for improved airflow through a structure which utilizes an HVAC system.

BACKGROUND

Modern HVAC systems, particularly well-insulated high-efficiency HVAC systems, require a return unit to move uncirculated air back into an air handler for processing. Many building structures will usually include one or two return units in hallways or large communal spaces which are meant to draw air from various rooms in the building to promote better re-circulation throughout the air conditioning system. However, if the doors to these rooms are closed, only a minimal amount of air is able to escape and recirculate back to the return unit. As defined herein, the term "peripheral room" is defined as a room which is adjacent to a "communal" room such as a hallway in which the return unit is installed within; i.e. if the return unit is installed within a back hallway, surrounding bedrooms which open to the hallway are considered to be peripheral rooms. If the peripheral rooms contain supply vents but are unable to adequately move uncirculated air out of the room, such rooms remain at high volumetric pressure while adjacent hallways or communal spaces may remain at low volumetric pressure. This, of course, will negatively affect total air circulation throughout the HVAC system, thereby applying unnecessary stress on air handlers that can create a stuffy, hot, or otherwise uncomfortable living or working space.

Existing solutions to this issue of poor return air circulation include the installation of vents in the door or wall above the door which separates the peripheral room from the hallway or communal space to allow air to escape from the room and into the communal space. However, this solution often requires a compromise, such as lack of privacy and poor noise insulation due to vents leading directly outside the room as well as the negative pressure created by the inefficient operation of the air handler failing to sufficiently draw air from peripheral rooms through the vents, the hallway, and into the return unit, particularly when the peripheral rooms are not located directly proximate to the air handler.

It is with these observations in mind, among others, that various aspects of the present disclosure were conceived and developed.

BRIEF DESCRIPTION OF THE DRAWINGS

Corresponding reference characters indicate corresponding elements among the view of the drawings. The headings used in the figures do not limit the scope of the claims.

DETAILED DESCRIPTION

Figure 1:
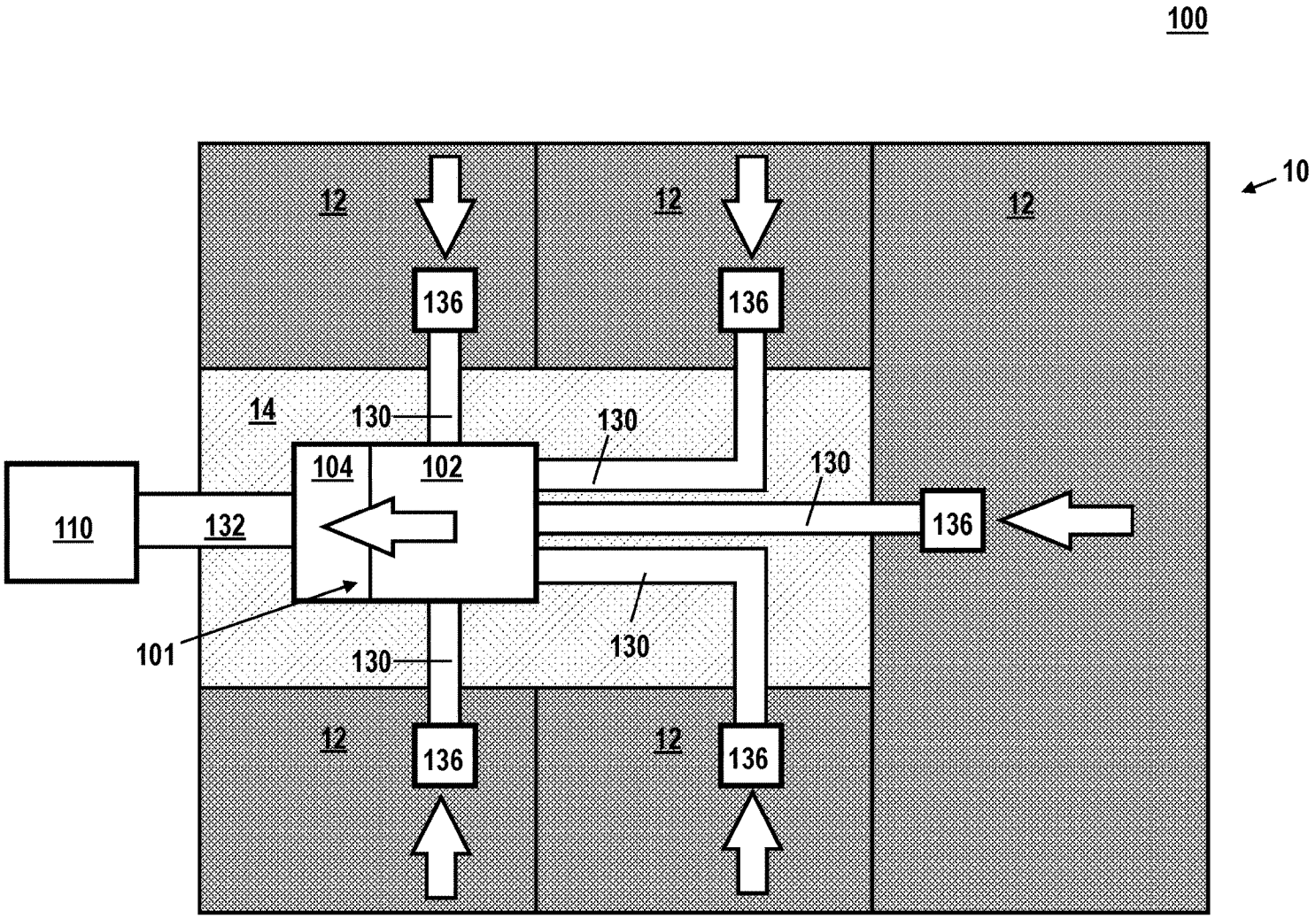
FIG. 1 is an aerial view showing an exemplary HVAC return system using a return unit for a plurality of rooms including at least one communal room and a plurality of peripheral rooms.
Figure 2:
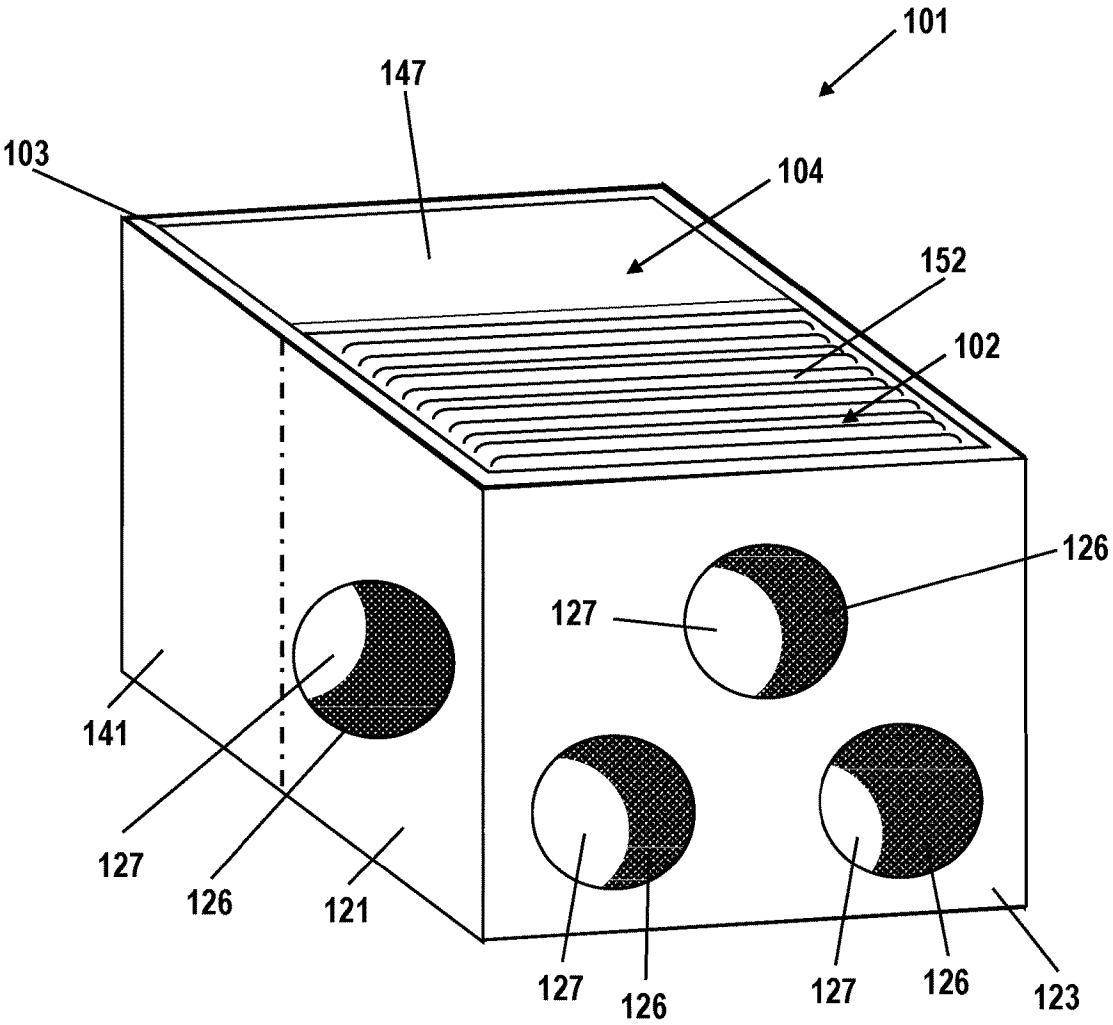
FIG. 2 is a perspective view showing the return unit of FIG. 1 showing a return grill of a first section and a first horizontal face of a second section.
Figure 3:
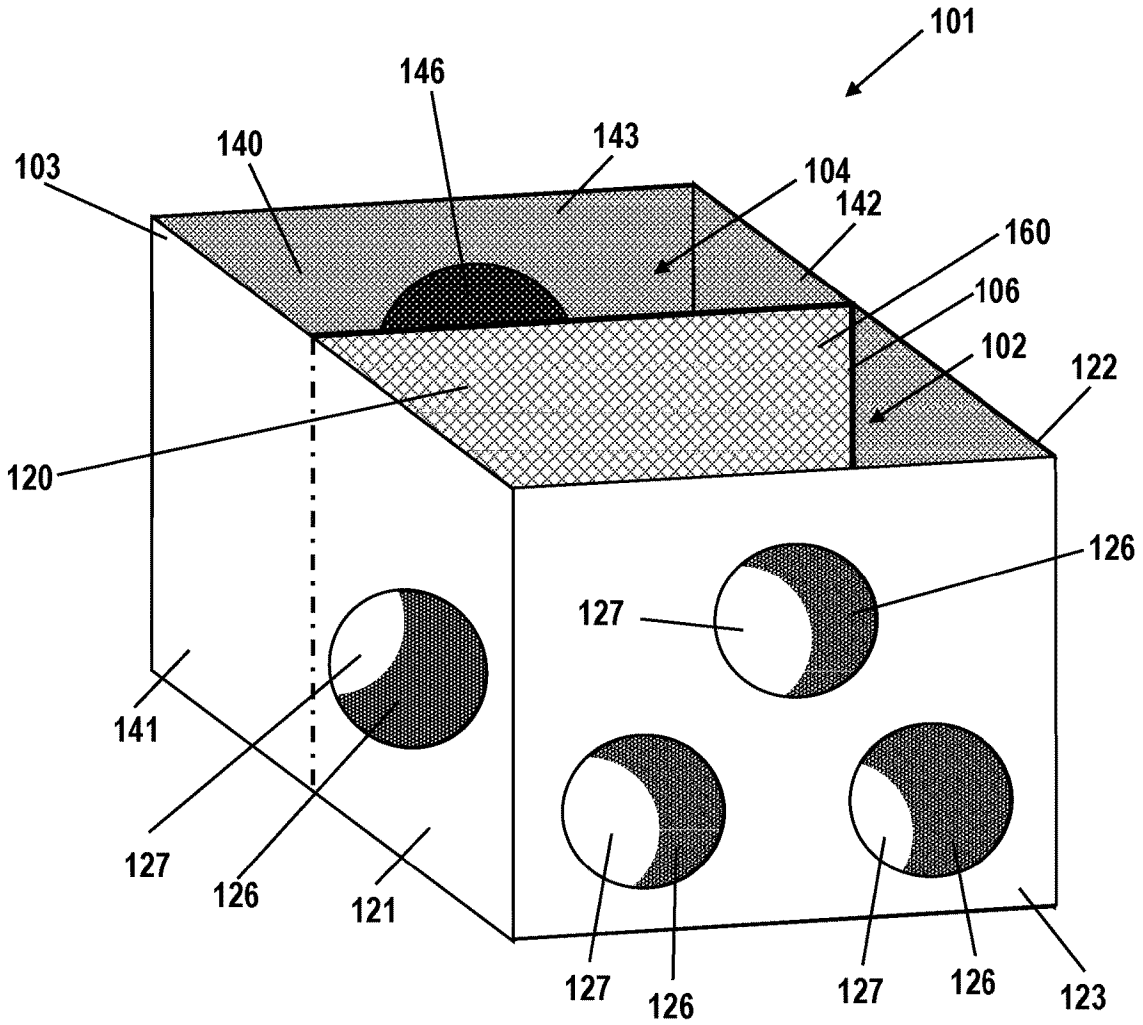
FIG. 3 is a perspective view of the return unit of FIG. 1 with the return grill of the first section and the first horizontal face of the second section removed to reveal a filter.
Figure 4:
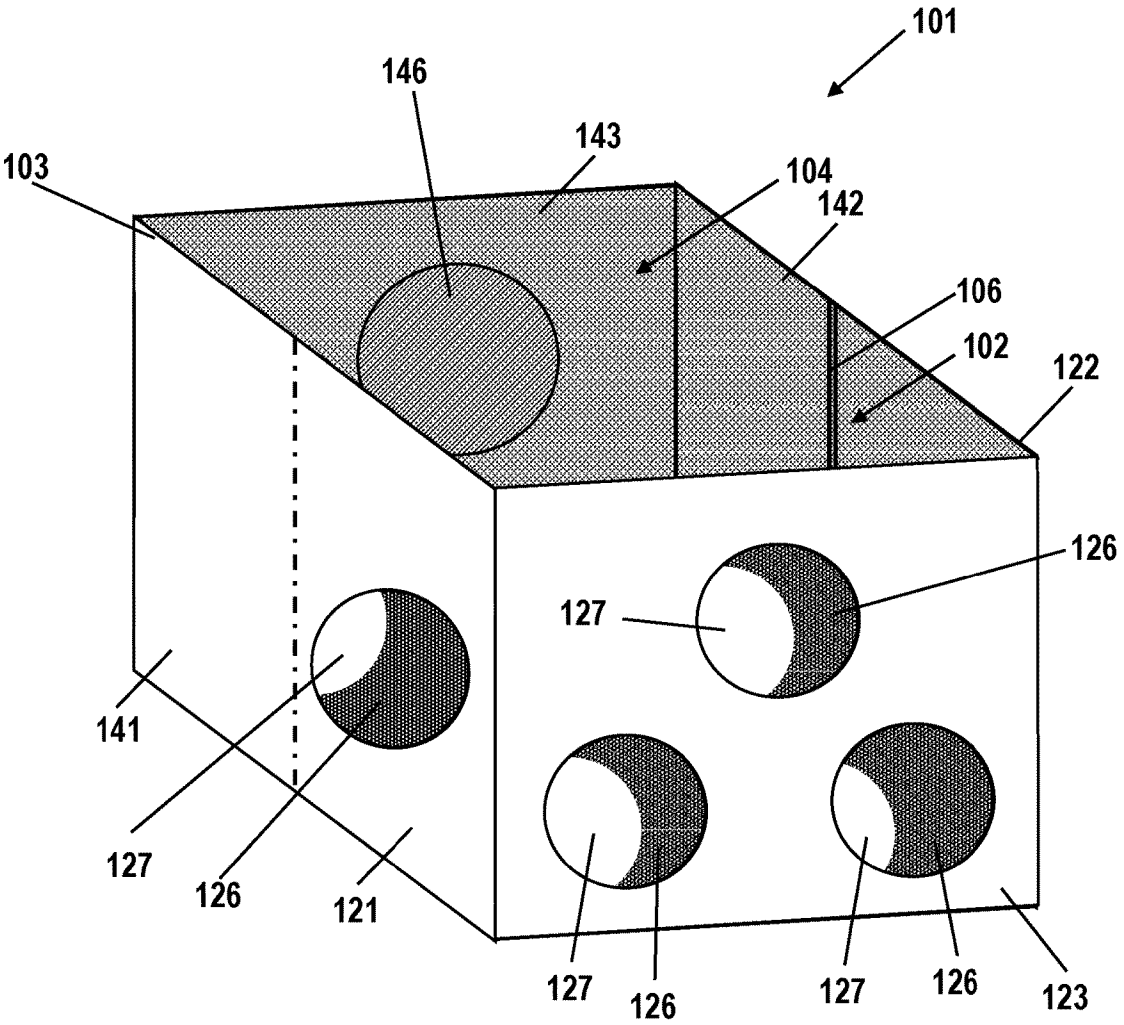
FIG. 4 is a perspective view of the return unit of FIG. 3 with the filter removed.
Figure 5:
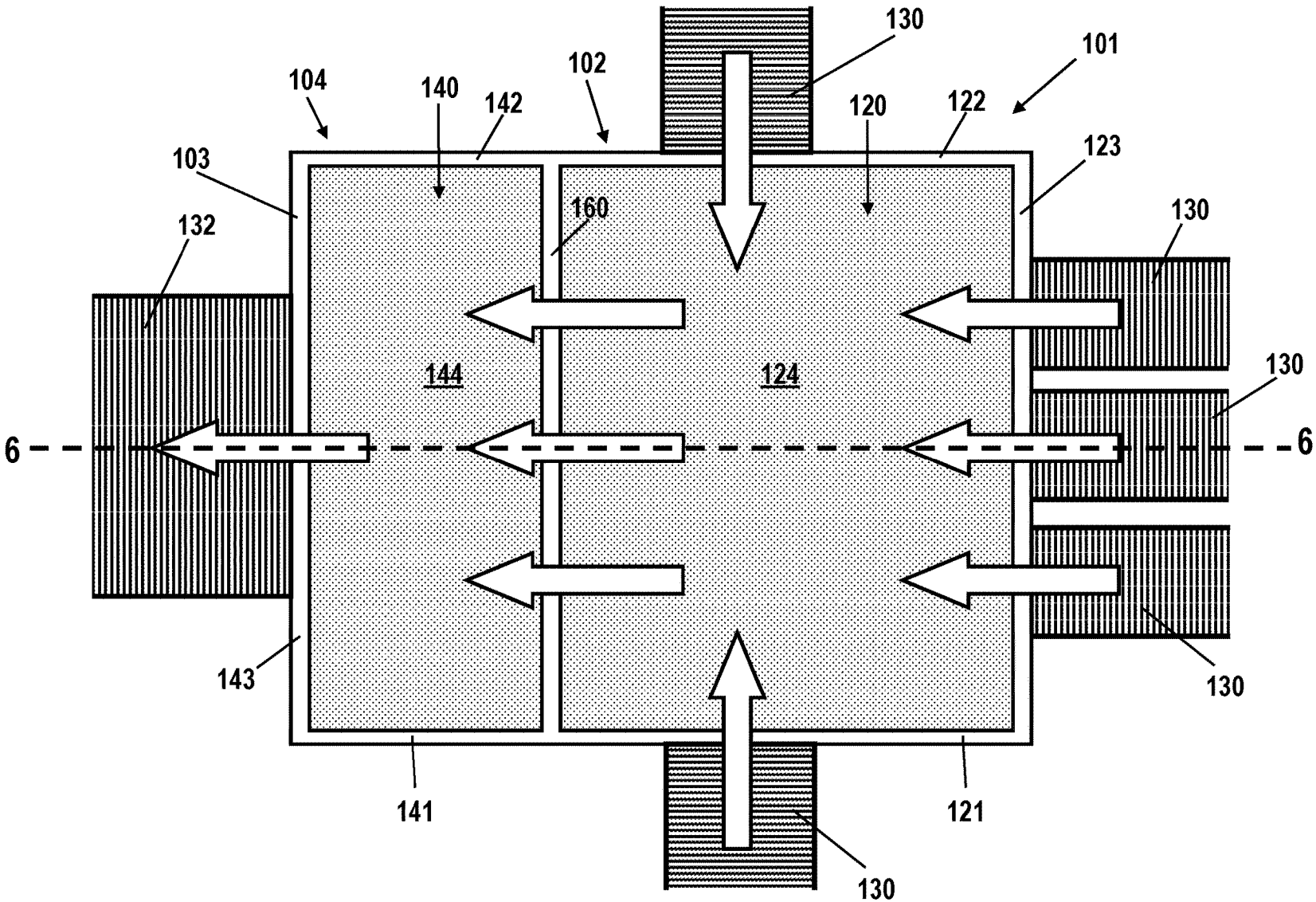
FIG. 5 is a top view showing the return unit of FIG. 1 with the return grill of the first section and the first horizontal face of the second section removed.
Figure 6:
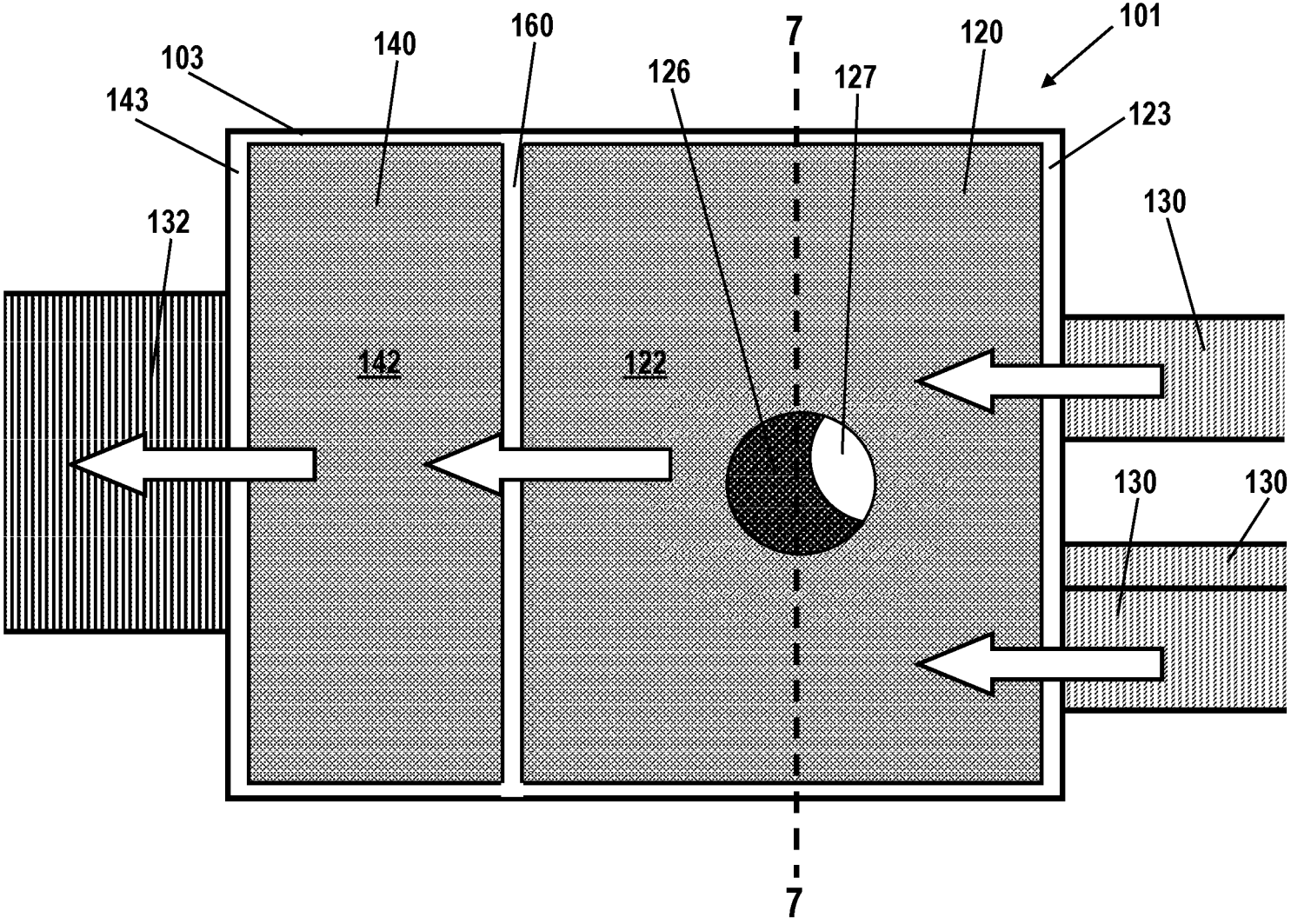
FIG. 6 is a cross-sectional side view showing the return unit of FIG. 5 taken along line 6-6.
Figure 7:
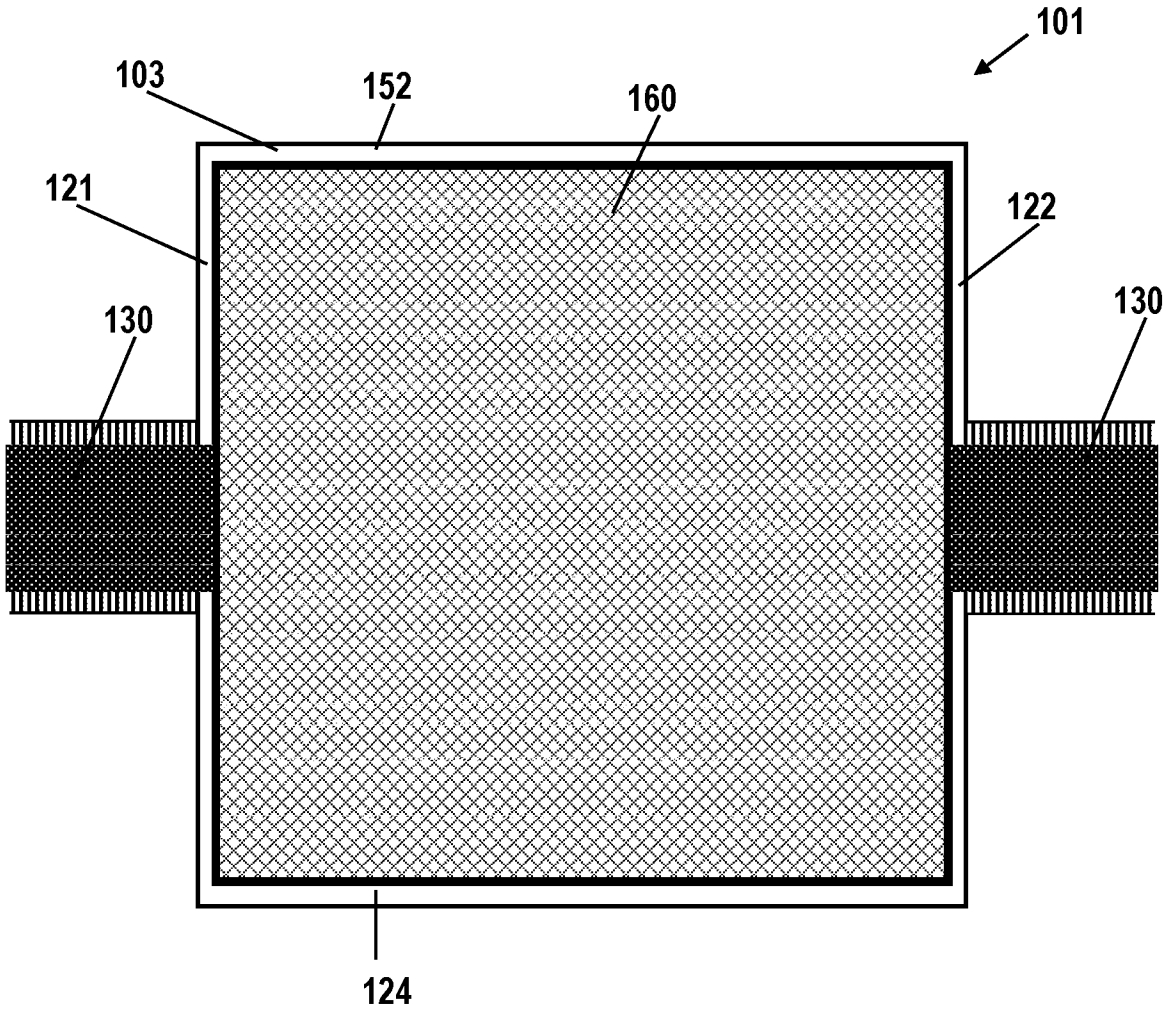
FIG. 7 is a cross-sectional front view showing the return unit of FIG. 6 taken along line 7-7.

Various embodiments of an HVAC return system having an improved return unit with a direct jumper arrangement for improved air circulation within an HVAC system of a space are disclosed herein. In some embodiments, the return unit is configured for installation between an air handler and a plurality of rooms including peripheral rooms, such as bedrooms, and communal rooms, such as hallways, to optimize air circulation from the plurality of rooms back to the air handler. The return unit defines a first section defining a first chamber and a second section defining a second chamber. The first chamber and the second chamber are separated by a filter such that air can be passed from the first chamber to the second chamber through the filter. The first chamber communicates directly with the plurality of rooms through a plurality of jumpers, and the second chamber communicates directly with the air handler to draw air from the plurality of rooms into the air handler. By acting as a node to enable all rooms to communicate with the air handler within one degree of separation from the air handler, and by eliminating downstream branching, the airflow within a space can be improved. The first chamber is associated with a plurality of dampers associated with each jumper to allow airflow rate modulation between each room.

During operation, negative pressure introduced into the HVAC system by the air handler pulls air from each of the plurality of peripheral rooms through the jumper vents and directly into the first section of the return unit. Air from the first section is then drawn through the filter, into the second section of the return unit, which leads to an air handler, either directly or indirectly, via a duct. Referring to the drawings, an embodiment of the HVAC return system using the return unit is illustrated and generally indicated as 100 in FIGS. 1-11B.

Referring to FIGS. 1-7, an HVAC return system 100 is illustrated including an improved return unit 101 configured to provide a direct route for airflow between an air handler 110 of the HVAC return system 100 and a plurality of rooms 10 including one or more peripheral rooms 12 and a communal room 14 to optimize air circulation from each the plurality of rooms 10 back to the air handler 110. The return unit 101 defines a first section 102 forming a first chamber 120 and a second section 104 forming a second chamber 140. The return unit 101 further includes a filter slot 106 located between the first section 102 and the second section 104 for retention of a filter 160 that acts as a porous barrier such that air can be passed from the first chamber 120 to the second chamber 140 through the filter 160. The first section 102 includes a plurality of apertures 126, wherein each aperture 126 of the plurality of entrance apertures 126 is associated with a respective jumper 130 of a plurality of jumpers 130 in a direct jumper arrangement shown in FIG. 1.

The direct jumper arrangement enabled by the return unit 101 of the HVAC return system 100 allows each peripheral room 14 of the plurality of rooms 10 to communicate directly with the return unit 101 through a respective jumper 130 of the plurality of jumpers 130. This allows the air handler 110 to draw air at a controlled rate from each individual peripheral room 14. When installed within the HVAC return system 100, the first chamber 120 is in fluid flow communication with the plurality of rooms 10 and the second chamber 140 is in fluid flow communication with the air handler 110. The air handler 110 generates negative pressure to draw air from the plurality of rooms 10 and into the first chamber 120, through the filter 160, into the second chamber 140, and finally into the air handler 110. Since the negative pressure generated by the air handler 110 is equalized at each aperture 126 of the return unit 101, a rate of airflow for each individual room 10 of the plurality of rooms 10 can be easily modulated at the return unit 101 using one or more dampers 127 installed within each respective aperture 126 to limit an amount of air drawn from a particular room 10. In another embodiment, the one or more dampers 127 are not present within the apertures 126 of the return unit 101, but are instead located inside an associated jumper 130 or jumper vent 136. This allows one to set and adjust airflow out of the room 10 and balance the HVAC return system 100 throughout the space. In one aspect, the return unit 101 provides a node in the HVAC return system 100 for each room 10 of the plurality of rooms 10 to communicate with the air handler 110 within one degree of separation.

FIGS. 2-7 in particular illustrate one embodiment of the return unit 101 defining a generally cuboid body 103 that includes the first section 102 and the second section 104. The return unit 101 provides a direct route for airflow between the air handler 110 (FIG. 1) and a plurality of rooms 10. In some embodiments, the filter slot 106 and associated filter 160, when engaged within the filter slot 106, separate the first section 102 from the second section 104. The filter 160 traps particles that enter the first section 102 and prevents them from entering the second section 102, while allowing passage of air from the first section 102 into the second section 104. The filter slot 106 is configured to receive the filter 160, which in some embodiments is a removable and replaceable sheet of material.

The first section 102 further includes a first chamber 120 defined collectively by a first horizontal face 151, an opposite second horizontal face 124, a first lateral face 121, an opposite second lateral face 122, and a proximal face 123 of the first section 102. The first lateral face 121, the opposite second lateral face 122, and the proximal face 123 can each include one or more apertures 126, wherein each aperture 126 is configured to engage with a respective jumper 130 for fluid flow communication with the plurality of rooms 10. Each aperture 126 can include a respective damper 127 for modulating a rate of airflow through the aperture 126. In some embodiments, the first horizontal face 151 defines a return grill 152 for drawing air from a communal room 14 located outside or below the first horizontal face 151. In some embodiments, the return grill 152 can include a grill damper 153 (FIG. 9) for modulating a rate of airflow through the return grill 152 and into the first chamber 120. In another embodiment, the return grill 152 is configured to receive a filter (not shown).

Referring again to FIGS. 2-7, the second section 104 is located proximate the first section 102 and receives air from the first section 102 through the filter 160 as the air is drawn into the air handler 110 from the second chamber 140 of the second section 104. The second chamber 140 similarly defined collectively by a first horizontal face 147, an opposite second horizontal face 144, a first lateral face 141, an opposite second lateral face 142, and a distal face 143 of the second section 104. The distal face 143 includes at least one air handler aperture 146 configured for engagement with an air handler conduit 132 for fluid flow communication with the air handler 110. In most embodiments, the remaining first horizontal face 147, opposite second horizontal face 144, first lateral face 141, and opposite second lateral face 142 of the second section 104 are sealed to prevent air from being directed away from the air handler aperture 146.

Referring to FIGS. 1 and 5-7, the HVAC return system 100 includes the return unit 101 in fluid flow communication with the plurality of rooms 10 and the air handler 110. In the example shown in FIG. 1, the plurality of rooms 10 includes a plurality of peripheral rooms 12 and a single communal room 14, i.e. several bedrooms and an adjacent hallway. Each peripheral room 12 includes a respective jumper vent 136 that communicates with the first chamber 120 of the return unit 101 by an associated jumper 130 of the plurality of jumpers 130. The negative pressure generated at each jumper vent 136 by the air handler 110 draws air from each peripheral room 12 and into its respective jumper 130 through the associated jumper vent 136. Each jumper 130 communicates directly with the first chamber 120 of the return unit 101 such that air drawn from each peripheral room 12 by the air handler 110 is drawn into the first chamber 120 from each respective jumper 130. In some embodiments, the return grill 152 additionally draws air from the communal room 14 and into the first chamber 120 to balance airflow between the communal room 14 and associated peripheral rooms 12. Air that has been drawn into the first chamber 120 of the first section 102 of the return unit 101 is then drawn through the filter 160 and into the second chamber 120 of the second section 104. The second section 104 communicates directly with the air handler 110 by the air handler conduit 132 such that air is drawn from the second chamber 120 of the second section 104 and into the air handler 110 for recirculation.

In one aspect, the air handler 110 introduces negative pressure into the HVAC return system 100, thereby causing air to be drawn into the air handler 110. The HVAC return system 100 leverages this negative pressure introduced by the air handler 110 to balance air pressure and airflow in peripheral rooms 12 and the communal space 14, in contrast to existing HVAC systems which do not directly draw air from peripheral rooms and into an associated return unit. Conventional HVAC systems have no means of directly controlling the volumetric flow of air leaving each peripheral room, as air is pulled through the return unit through a main return conduit. In existing HVAC systems, a main return conduit is embodied as a hallway or a main duct with one or more downstream branches that open into peripheral rooms; this arrangement can cause the flow of air out of a peripheral room to be uncontrolled. To illustrate, if a main branching conduit is used, peripheral rooms located at a far branch will not draw air at the same rate as peripheral rooms which are associated with branches that are closer to the return unit. If the main return conduit is embodied as a hallway, the issue still remains in which peripheral rooms rely solely on respective fluid flow communication with a respective hallway to draw sufficient air from the peripheral rooms; however, this arrangement fails to properly control the volumetric flow of air for each peripheral room.

Figure 8C:
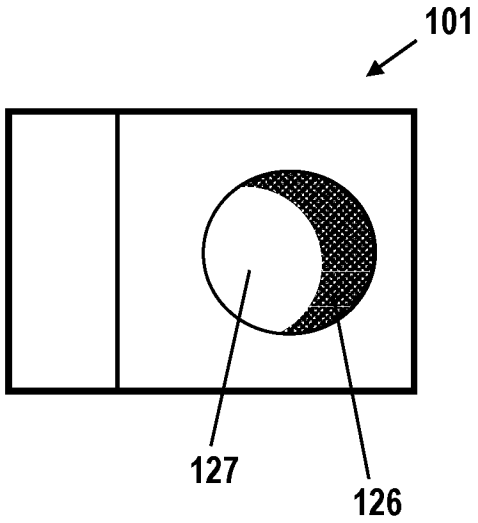
FIGS. 8A-8C are a series of side views showing a damper installed within an aperture of the return unit of FIG. 1 to adjust the volumetric flow rate of air through the aperture.
Figure 8B:
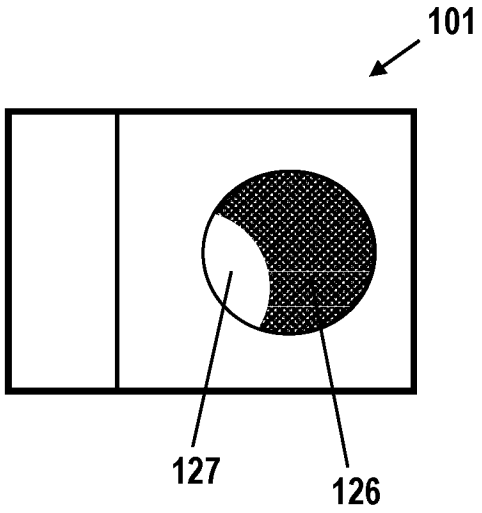
Figure 8A:
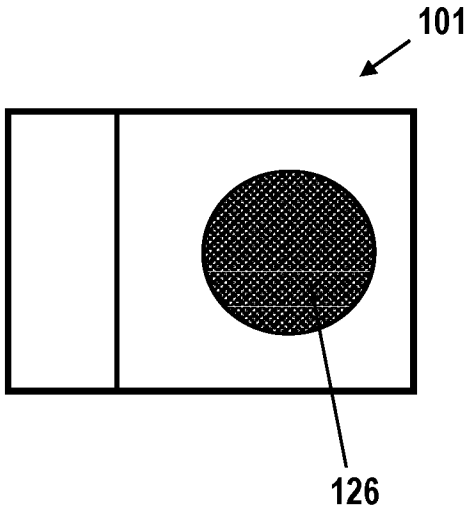
Figure 9:
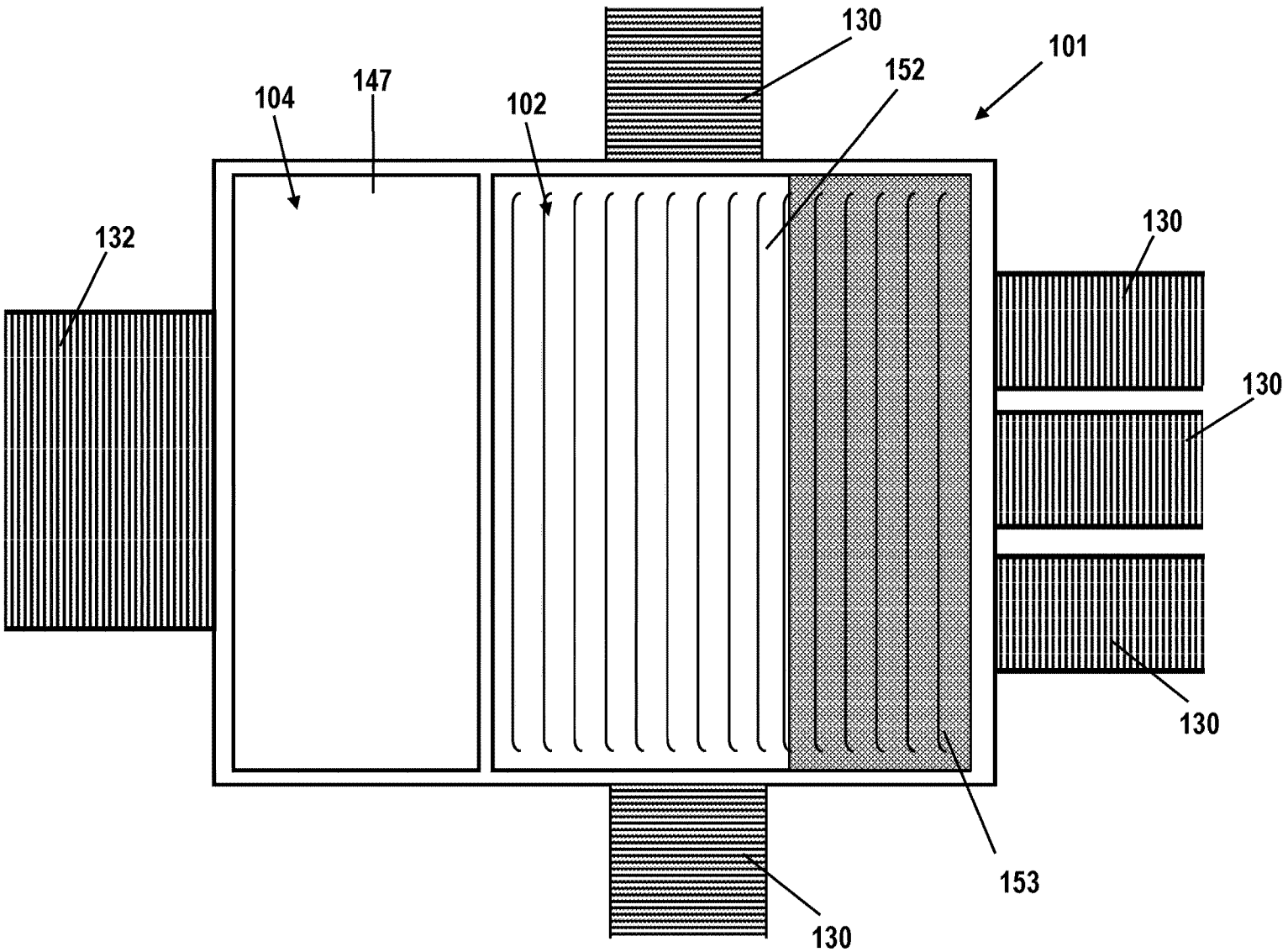
FIG. 9 is a top view of a grill damper installed within a return grill of the return unit of FIG. 1.

In contrast, the return unit 101 of the present HVAC return system 100 leverages the negative pressure introduced by the air handler 110 to eliminate the main return conduit and draw air directly from peripheral rooms 12 and into the return unit 101 through the plurality of jumpers 130 that communicate directly with the first section 102 of the return unit 101. In this manner, negative pressure can be sufficiently balanced to allow the volumetric pressure to be equalized between each respective peripheral room 12 and the common spaces 14. In some embodiments, referring to FIGS. 8A-8C, the volumetric flow leaving each of the peripheral rooms 12 through each jumper 130 of the plurality of jumpers 130 may be controlled using one or more dampers 127 strategically installed within the one or more apertures 126 of the first section 102. In another embodiment, the one or more dampers 127 are not present within the apertures 126 of the return unit 101, but are instead located inside an associated jumper 130 or jumper vent 136. FIG. 8A illustrates an aperture 126 of the return unit 101 without a damper, thus airflow though the aperture 126 is unrestricted. FIG. 8B illustrates a damper 127 installed within the aperture 126 and partially restricting airflow through the aperture. The damper 127 can be moved to restrict more or less of the aperture, as shown in FIG. 8C. Similarly, referring to FIG. 9, grill damper 153 can be installed behind the return grill 152 for restricting airflow through the return grill 152 and into the first section 102.

Figure 10:
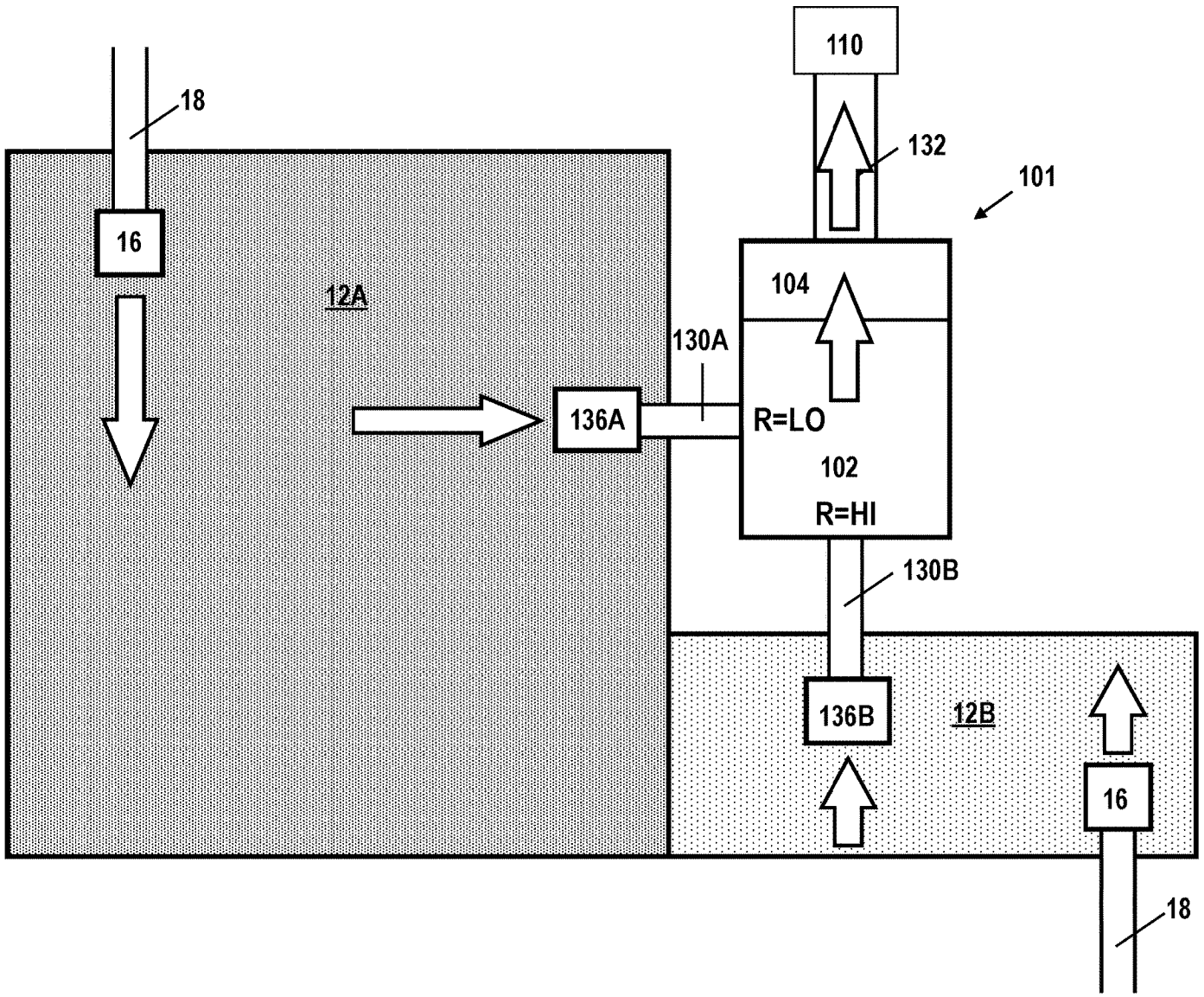
FIG. 10 is a simplified illustration of an exemplary HVAC return system showing a large room and a small room and illustrating a variation in required volumetric flow rate required to balance each room in communication with the HVAC return system.

In the example shown in FIG. 10, a large peripheral room 12A and a small peripheral room 12B are illustrated in fluid flow communication with the return unit 101 by respective jumper vents 136A and 136B and associated jumpers 130A and 130B for drawing air out of the peripheral rooms 12A and 12B. In the example shown, large peripheral room 12A and small peripheral room 12B each receive air drawn from an associated supply vent 16 and supply jumper 18. In order to draw air from both the large peripheral room 12A and the small peripheral room 12B at a balanced airflow rate between the two, airflow from the small peripheral room 12B can be restricted (R=HI) using a damper 127 to cause the rate of airflow from the large peripheral room 12A to increase. Further, low airflow restriction (R=LO) from the large peripheral room 12A allows the air handler 110 to draw air from the large peripheral room 12A at a faster rate than the small peripheral room 12B, thus allowing control over airflow regardless of the size of the room or strength of supply airflow from an HVAC supply system.

The direct jumper arrangement of the return unit 101 allows appropriate distribution of negative pressure produced by the air handler 110 in which larger peripheral rooms such as large peripheral room 12A in FIG. 10 require a higher volumetric flow of air being drawn from the large peripheral room 12A, while small peripheral rooms such as small peripheral room 12B require a lower volumetric flow of air being drawn from the small peripheral room 12B. Using the return unit 101 with the direct jumper arrangement in the HVAC return system 100, airflow may be balanced such that volumetric air pressure in each peripheral room 12 is equalized relative to one another and in some embodiments the communal space 14 (FIG. 1). With proper damper 127/153 installation, volumetric flow of air entering a peripheral room 12 or a communal space 14 through supply vents 16 is equal to volumetric flow of air leaving the peripheral room 12 or the communal space 14 through each jumper vent 220, thus eliminating over-pressure or under-pressure situations. Return unit 101 allows adjustment over the volumetric flow of air drawn from room 12 or 14. In addition, negative pressure generated by the air handler 110 is efficiently distributed between the peripheral rooms 12 and communal spaces 14 of different sizes.

Figure 11B:
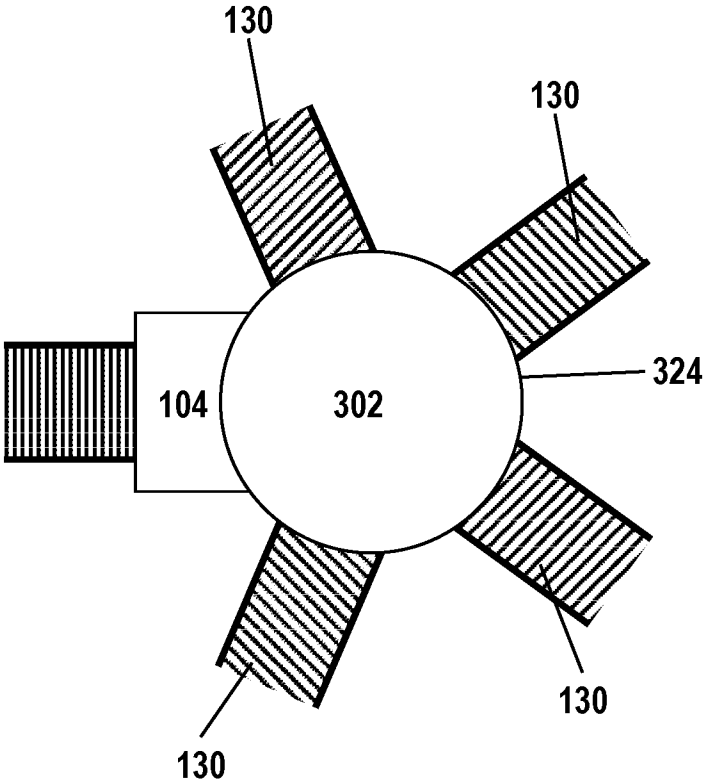
FIGS. 11A and 11B are simplified top illustrations showing alternate embodiments of a first chamber of the return unit of FIG. 1.
Figure 11A:
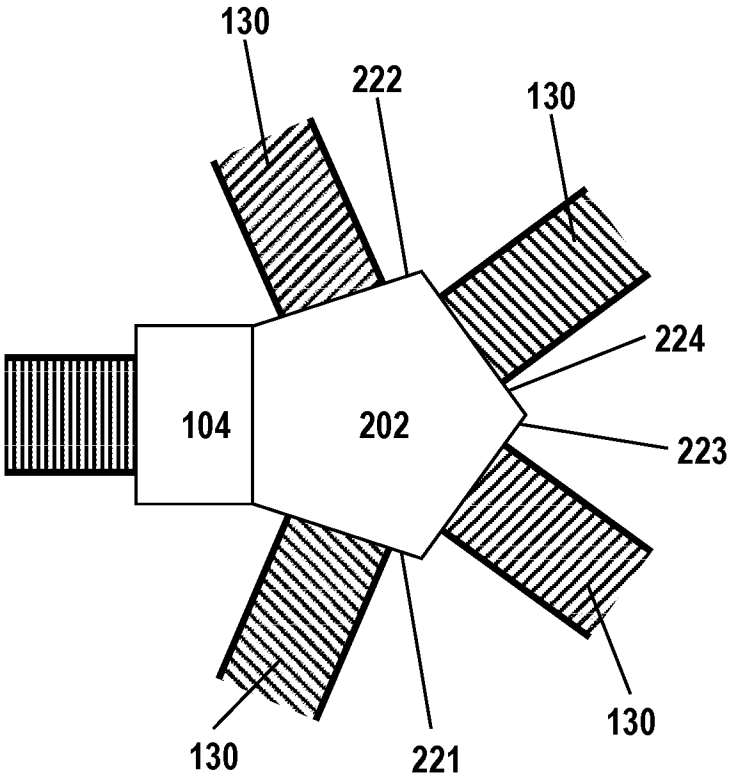

In some embodiments, the return unit 101 is fabricated from galvanized steel or another material suitable for HVAC applications. Referring to FIGS. 11A and 11B, the first section 102 can embody respective alternate first sections 202 and 302. While the above description of the first section 102 makes reference to lateral faces 121 and 122 and proximal face 123 (FIG. 5), an alternative first section 202 shows an additional face 224 in addition to lateral faces 221, 222 and an analogous proximal face 223 to provide additional surface area for attachment of jumpers 130. It should be noted that return unit 101 and associated embodiments can include any number of faces for attachment of jumpers 130. For example, alternate first section 302 in FIG. 11B includes only one face 324 for attachment of jumpers 130.

Testing Data

In one example, the HVAC return system 100 was installed within a 1245*sf* residence. Before and after installation, pressure pan duct testing was performed.

TABLE 1

Pressure Pan Duct Testing

| Register Location | Initial Pressure (Pa) | Post-installation Pressure (Pa) |
|---|---|---|
| LIV | 9.6 | 0.1 |
| Bedroom 1 | 9.8 | 0.0 |
| Dining | 9.7 | 0.1 |
| Kitchen | 9.5 | 0.0 |
| Bedroom 2 | 9.1 | 0.2 |
| Hall bath | 9.0 | 0.2 |
| Master Bath | 9.4 | 0.0 |
| Master Bed | 9.4 | 0.0 |
| Return | 5.3 | 0.4 |

Prior to installation, an average pressure in each duct was found to be about 9.0 Pa. Following installation, the average pressure in each duct was found to be nearly equalized to zero.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. A ventilation return system, comprising:

a return unit for a plurality of rooms, including:

a body defining a first section in fluid flow communication with a second section, wherein the first section includes:

at least one face collectively defining a first chamber, wherein the first chamber is at least partially enclosed and wherein the at least one face includes a plurality of apertures; and wherein the second section includes:

at least one face collectively defining a second chamber, wherein the second chamber is in fluid flow communication with the first chamber and wherein the at least one face includes an air handler aperture;

a plurality of jumpers in communication with the return unit, each of the plurality of jumpers extending directly from the first section of the return unit to a respective jumper vent configured to draw return air from a respective room of the plurality of rooms, each of the plurality of jumpers in direct fluid flow communication with the first chamber of the first section via a respective aperture of the plurality of apertures of the return unit, and each of the plurality of jumpers being separated from one another to better control airflow;

a plurality of dampeners, at least one of the plurality of dampeners in communication with each of the plurality of jumpers to restrict airflow for a given jumper and provide individualized distribution of negative pressure and airflow through each of the plurality of jumpers from each room of the plurality of rooms; and an air handler in fluid flow communication with the air handler aperture of the return unit and operable for drawing air through the return unit from the plurality of jumpers.

2. The ventilation return system of claim 1, further comprising:

a filter slot defined between the first chamber and the second chamber, wherein the filter slot is configured to receive a filter and wherein the filter comprises a porous material that allows passage of air through the filter from the first chamber to the second chamber.

3. The ventilation return system of claim 1, wherein the plurality of dampeners causes airflow from a first room of the plurality of rooms to be restricted and provide less airflow than a second room of the plurality of rooms.

4. The ventilation return system of claim 1, further comprising:

an air handler conduit configured for establishing fluid flow communication between the air handler and the second section of the return unit.

5. The ventilation return system of claim 1, wherein the plurality of jumpers establishes a fluid flow communication between a respective jumper vent and the first section of the return unit.

6. The ventilation return system of claim 1, wherein the return unit further includes a first horizontal face defining a return grill, wherein air is drawn into the first chamber of the return unit through the return grill.

7. The ventilation return system of claim 6, wherein the return grill is located in a communal room such that air is drawn through the return grill and into the first chamber of the return unit from the communal room.

8. The ventilation return system of claim 6, further comprising:

one or more grill dampers of the plurality of dampers disposed within the return grill, wherein the one or more grill dampers are configured to restrict volumetric flow of air which is drawn into the first chamber from a communal room by the air handler.

9. The ventilation return system of claim 1, wherein the plurality of dampeners accommodate selective restriction of airflow drawn through the plurality of jumpers.

10. The ventilation return system of claim 1, wherein air is drawn directly from one or more peripheral rooms and into the return unit by the air handler.

* * * * *